US008757186B2

(12) United States Patent
Vulpitta et al.

(10) Patent No.: US 8,757,186 B2
(45) Date of Patent: Jun. 24, 2014

(54) ATTIC ACCESS DOOR SEAL

(75) Inventors: Brian A. Vulpitta, Avon Lake, OH (US); Daniel Festa, Strongsville, OH (US); Vageesh Bakhshi, Brecksville, OH (US)

(73) Assignee: Shurtech Brands, LLC, Avon, OH (US)

( * ) Notice: Subject to any disclaimer, the term of this patent is extended or adjusted under 35 U.S.C. 154(b) by 0 days.

(21) Appl. No.: 13/456,863

(22) Filed: Apr. 26, 2012

(65) Prior Publication Data

US 2013/0284625 A1 Oct. 31, 2013

(51) Int. Cl.
*E04H 15/02* (2006.01)
*E04B 7/00* (2006.01)

(52) U.S. Cl.
USPC ..... 135/96; 135/136; 135/117; 52/202; 182/81

(58) Field of Classification Search
USPC ..... 135/96, 124, 136, 156, 119, 905–906, 135/117; 52/19–20, 56, 72, 199, 202–203, 52/204.2; 182/46–47, 63, 77–81; 49/463–466, 475.1
See application file for complete search history.

(56) References Cited

U.S. PATENT DOCUMENTS

| | | | | |
|---|---|---|---|---|
| 2,167,219 | A * | 7/1939 | Sankey | 135/133 |
| 4,352,362 | A * | 10/1982 | Nichols | 135/98 |
| 4,658,555 | A | 4/1987 | Steiner | |
| 4,928,441 | A * | 5/1990 | Daley | 52/19 |
| 4,993,471 | A * | 2/1991 | Golden | 160/370.21 |
| 5,078,096 | A * | 1/1992 | Bishop et al. | 119/497 |
| 5,274,966 | A | 1/1994 | Daley | |
| 5,475,955 | A | 12/1995 | Dickinson | |
| 5,481,833 | A * | 1/1996 | Williams | 52/19 |
| 5,547,734 | A * | 8/1996 | Tusch | 428/102 |
| 5,623,795 | A | 4/1997 | Padgett, Jr. | |
| D396,086 | S | 7/1998 | Cantwell | |
| 6,167,898 | B1 * | 1/2001 | Larga et al. | 135/137 |
| 6,170,504 | B1 | 1/2001 | Tsai | |
| 6,223,490 | B1 | 5/2001 | Wessley et al. | |
| 6,257,263 | B1 | 7/2001 | Brereton | |
| 6,450,186 | B1 * | 9/2002 | Pearcy | 135/96 |
| 6,463,948 | B2 * | 10/2002 | Lee | 135/156 |
| 6,601,352 | B1 | 8/2003 | Obermeyer et al. | |
| 6,848,492 | B2 | 2/2005 | Thomas | |
| 6,966,153 | B2 | 11/2005 | Panetta et al. | |
| 7,434,363 | B2 | 10/2008 | Panetta et al. | |
| 7,481,234 | B1 * | 1/2009 | Gustafson et al. | 135/91 |
| 7,665,478 | B2 * | 2/2010 | Wehner | 135/126 |
| 7,841,134 | B2 | 11/2010 | Verry | |
| 2009/0094908 | A1 | 4/2009 | Krueger et al. | |
| 2009/0188539 | A1 | 7/2009 | Hollinger | |

* cited by examiner

*Primary Examiner* — Winnie Yip
(74) *Attorney, Agent, or Firm* — Fay Sharpe LLP

(57) ABSTRACT

An insulating cover is adapted for sealing an attic access panel. The insulating cover includes a substantially rectangular fabric layer and at least one rod for raising the fabric layer above the attic access panel. A cavity is defined by the fabric layer and is adapted to contain a volume of stationary air. A seal is formed around a perimeter of the fabric layer. The seal includes multiple fiber strands of material that are adapted to conform to a shape of a floor surface. The fiber strands are adapted to seal gaps formed where the cover meets the floor surface.

17 Claims, 8 Drawing Sheets

10
12
14
16
18
20
22
24
26
28
30
32
34
36
38
40
42
42A
42B
48
202
204
206
208
210
212

ATTIC ACCESS DOOR SEAL

BACKGROUND

The present disclosure is related to an insulating cover for an attic access panel and, more specifically, to an insulating cover including a seal formed of multiple strands and/or fabric layers of material. The strands are adapted to collectively conform to a shape of a floor surface and seal any gaps formed where the cover meets the floor.

An attic is usually an under-constructed space in a structure that may provide, for example, extra storage. Therefore, an attic door panel or hatch usually provides access to the attic space. Because attic and living spaces are built to different codes and standards, the access panel may cause the structure to suffer from undesirable energy loss.

For example, ventilation and insulation techniques differ for living spaces and attic spaces. Most attics are not sufficiently insulated, so temperatures can significantly deviate from a controlled temperature that is maintained in the living space of the structure.

Ventilation is also different in attics. Model building codes require attic spaces to be ventilated. A ventilated attic receives an air current that is pulled from outside the structure. This air current is typically pulled in from a floor region of the attic space and travels upwardly toward the most elevated region of the attic, where it is returned to the exterior environment.

Because there is no significant risk of water leakage at an attic access panel, attic access panels do not generally include air-tight seals. During cooler seasons, the temperature is controlled to heat the functional spaces of a structure. Warm air rises because it has a lower density than cooler air. Therefore, the warm air can seep through the space formed between the access panel and its frame. The ventilation air stream carries this warm air to outside the structure. Even in structures not utilizing a ventilation system, heat in the structure may be lost through the access panel to the colder environment in the attic space. Additionally, heat is conducted through the access panel, thus causing the living space of the structure to lose heat to the attic in winter and air-conditioning in the summer.

In warmer conditions, extremely hot temperatures in the attic space may also draw more power from an air conditioner unit dedicated to maintaining a cooler temperature in the living space. Regardless of the season, utility costs may be unnecessarily driven to higher amounts based on inadequate insulation at the access panel. Inadequate insulation may cause the furnace and air conditioner appliances to consume more energy in an effort to compensate for temperature losses and/or gains at the attic access panel. A low-cost and easily positioned insulating cover is needed at the access panel for effectively preventing heat convection.

BRIEF DESCRIPTION

A first exemplary embodiment of the present disclosure is directed toward an insulating cover adapted for sealing an attic access panel. The insulating cover includes a substantially rectangular fabric layer and at least one rod for raising the fabric layer above the attic access panel. A cavity is defined by the fabric layer and is adapted to contain a volume of stationary air. A seal is formed around a perimeter of the fabric layer. The seal includes multiple fiber strands and layers of material that are adapted to conform to a shape of a floor surface. The fiber strands are adapted to seal gaps formed where the cover meets the floor surface.

A second exemplary embodiment of an insulating cover includes a generally flexible fabric layer formed of an insulating material. At least one tubular sleeve extends across a portion of the fabric layer. At least one semi-rigid rod is adapted to extend through the tubular sleeve. The rod is further adapted to position the fabric layer around the access panel. A seal extends around a perimeter of the fabric layer. The seal is adapted to lay against a floor surface adjacent the access panel when the fabric layer is raised by the rod. The seal includes multiple fiber strands that are adapted to conform to a non-uniform contact surface representative of the floor surface. The fiber strands are adapted for sealing a gap formed between the seal and the floor surface.

A third exemplary embodiment of the disclosure is directed toward a packaged insulation cover. The packaged insulation cover contains an insulation cover that is adapted for sealing an attic access panel. The packaged insulation cover includes a package and a generally flat and flexible fabric layer folded in the package. At least one rod is contained in the package. A seal extends around a perimeter of the fabric layer. The seal including multiple fiber strands that are adapted to conform to a non-uniform contact surface.

DETAILED DESCRIPTION

The present disclosure relates to an insulating cover for an attic access panel. The embodiments herein are more specifically described for ceiling attic access panels. However, the features described herein may be similarly utilized or modified for use with a side-entry attic access. The insulating cover aims to insulate the access panel from transferring heat between a non-temperature controlled attic space and a temperature controlled living and/or working space. Accordingly, it is anticipated that the features and construction described herein may find equal application for insulating (single or multiple, sectional) panels and doors situated in other structures, such as, for example, garages, temporary storage units, closet spaces, and underground cellars, etc.

Figures 1A, 1C, 2, 3, 4, 5, 6, 7, 8:
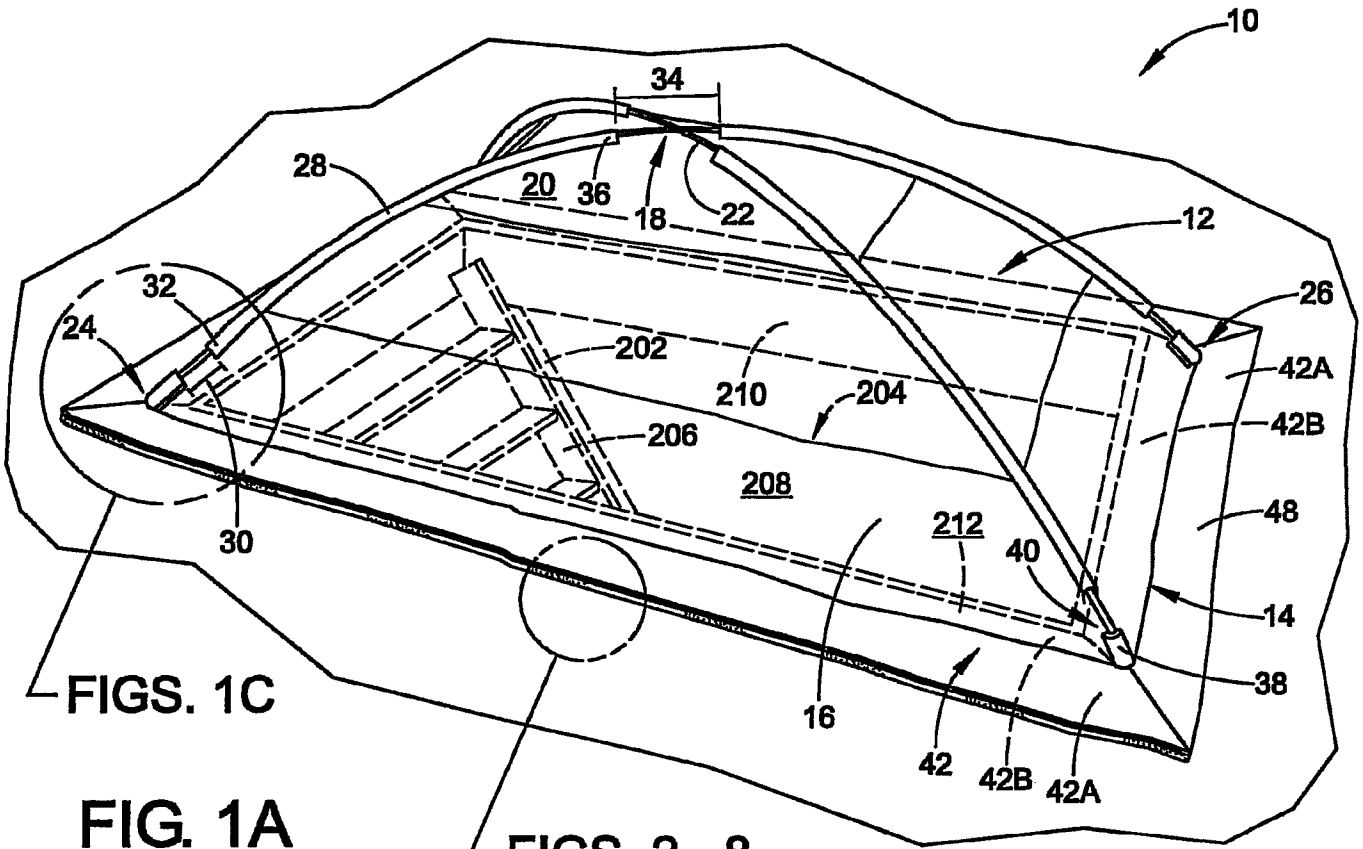
FIG. 1A illustrates a perspective view of an insulating cover according to the subject matter of the disclosure and observed from an attic space.
FIG. 1C illustrates an exploded partial perspective view of a seal according to an embodiment of the disclosure.
FIG. 2 illustrates an exploded view of a seal according to an embodiment of the disclosure.
FIG. 3 illustrates the seal shown in FIG. 2 in contact with a floor surface.
FIG. 4 illustrates an alternate embodiment of a seal including a foam layer.
FIG. 5 illustrates an alternate embodiment of the seal including two layers.
FIG. 6 illustrates an alternate embodiment of the seal including two layers.
FIGS. 7 and 8 illustrate an alternate embodiment of the seal including at least one fabric layer.

FIG. 1A illustrates a perspective view of an insulating cover 10 observed from an attic space. Most attics are made accessible by passage through an access panel or hatch 202, which includes a door hingedly connected to a wall or ceiling that is shared between the attic space and an indoor living or work space 204. This access panel 202 typically pivots downwardly toward a person accessing the attic from the living space. In many instances, a collapsible fold or pull down ladder 206 attaches to the panel 202 and is stored in a recess 208 defining a panel opening having standard dimensions. The ladder 206 is at least partially stored in the recess region 208 defined by a frame 210 during periods of non-use.

With continued reference to FIG. 1A, the attic access panel 202 is shown in an open position, but the insulating cover 10 is generally operative when the access panel is closed. The insulating cover 10 is shown in the assembled and operative position. The insulating cover 10 includes a generally rectangular fabric layer 12. The generally rectangular flexible fabric layer 12 is more particularly defined by a rectangular-shaped, frame-like seal 42. The seal 42 includes dimensions that are slightly greater than the dimensions of the recess 208 so that it completely surrounds and frames the recess 208. The fabric layer 12 is formed of four wedge-shaped portions 16. The wedge-shaped portions 16 are connected to the seal 42 at a seam and/or perimeter 14. The perimeter/seam 14 defines an outer edge of a wedge-shaped portion 16, which tapers toward a center 18 of the fabric layer 12.

In one embodiment, the seam 14 is formed along the extent of the seal 42 that is removed from the edges of the seal 42, such as along an extent proximate to the center of the seal. FIG. 1C illustrates a partial exploded view of the seal 42 having the seam 14 positioned in the center of the cross-sectional area of the seam 42. In this manner, the seam 14 can include a first (outer) seal portion 42A that extends outwardly from the wedge-shaped portions 16 and a second (inner) seal portion 42B that extends inwardly from the wedge-shaped portions. There is no limitation made herein to the relative widths of each seal portion 42A, 42B. The seal portions 42A, 42B can have equal widths when the seam 14 extends along a center of the seal 42. Alternatively, one seal portion 42A, 42B can have a width that is greater than the other seal portion.

In this manner, a seal portion 42A, 42B is formed on both sides of the wedge-shaped portions 16 where the wedge-shaped portions meet the floor.

The wedge-shaped portions 16 illustrated in FIG. 1A are parabolic in shape, but triangular-shaped portions are also contemplated in certain embodiments. When the insulating cover 10 is in a disassembled state, the wedge-shaped portions 16 may include a loose amount of fabric that is greater than a cross-sectional area defined by the perimeter 14. When the insulating cover 10 is in an assembled state, the fabric 12 stretches to define a tent-like structure that surrounds the access region while not contacting the access panel 202. More specifically, the fabric layer 12 defines a cavity 20 situated above the access panel 202. The cavity 20 is a closed space defined by floor surface 212, panel 202 and fabric layer 12 when the access panel 202 is in a closed position.

With continued reference to FIG. 1A, the cavity 20 is adapted to contain a volume of stationary air. Stationary air is an effective insulator because it prevents moving air currents from transferring heat from warmer environments to cooler environments. Another aspect of stationary air is that it is a poor conductor of heat. Therefore, the insulating cover 10 can provide the volume of stationary air contained above and surrounding the entire attic access region in the attic space. The fabric layer 12 is preferably also manufactured from an insulating material that prevents the movement of air, which furthermore reduces heat convection.

With continued reference to FIG. 1A, the insulating cover 10 includes at least one rod 22 for maintaining the fabric layer 12 in operative position. In the exemplary embodiment illustrated in FIG. 1A, referred to herein as a 'frameless cover', the insulating cover 10 includes two rods 22. In the illustrative embodiment, the rods 22 are semi-rigid rods that can bend to adapt to the parabolic contour of the wedge-shape portions 16, but maintain rigidity to support the fabric layer in an operative position. However, an embodiment is contemplated as including generally rigid rods when the wedge-shaped portions 16 are triangular-shaped.

With continued reference to FIG. 1A, each of the two rods 22 extends from a first corner 24 of the insulating cover 10 to an opposite corner 26 of the insulating cover 10. The insulating cover 10 includes at least one tubular sleeve 28 for receiving a rod 22. The exemplary embodiment includes twice a number of sleeves 28 to rods 22. However, one embodiment is contemplated as including three sleeves 28 for the two rods 22.

In one embodiment, the rods 22 are selectively received in the sleeves 28 during an assembly of the insulating cover 10 and are removed from the sleeves 28 during a disassembly of the insulating cover 10. In another embodiment, discussed later, the rods 22 extend through the sleeves 28 during packaging and generally remain in the sleeves 28 at all times.

With continued reference to FIG. 1A, each tubular sleeve 28 extends between the first corner 24 of the fabric layer 12 and the center 18 of the fabric layer 12. In one embodiment, one fabric sleeve 28 can extend between the first corner 24 of the fabric layer 12 and the opposite corner 26 of the fabric layer 12. In the exemplary embodiment, however, the tubular sleeve 28 does not reach either the corners 24, 26 or the center 18 of the fabric layer 12. Rather, a first (corner) gap 30 is formed between the corner 24, 26 and a first terminal end 32 of the tubular sleeve 28. A second (center) gap 34 is formed between the second terminal end 36 of the tubular sleeve 28 and the center 18. In other words, the second gap 34 is formed between adjacent terminal ends 36 of two sleeves 28 that are coincident along a shared axis. In this manner, the user can more easily manipulate the rod 22 into position across the fabric layer 12 by grabbing it midway between multiple sections and/or lengths of tubular sleeves 28. In this manner, the user can grab the rod 22 while it egresses a first sleeve 28 and continue to guide and feed it into the second sleeve 28 at approximately the center 18 of the fabric layer 12. The two rods 22 cross paths at the center 18 of the fabric layer 12. More specifically, a first rod 22 overlaps the second rod 22 where the rods intersect.

Because the rods 22 cross at the center 18 of the fabric layer 12, a contemplated embodiment of the insulating cover 20 may rather include three tubular sleeves 28. A first sleeve 28 extends between the first corner 24 and the opposite corner 26, but the second and third sleeves 28 extend from opposite corners 24, 26 toward the center 16 while leaving the gap 34 at the center 18 for the second rod 22 to cross over the first sleeve 28.

With continued reference to FIG. 1A, the tubular sleeves 28 are positioned on an outside oriented surface of the fabric layer 12, thus making them more accessible to the user during assembly. The sleeves 28 can be formed from a same material as the fabric layer 12 or a different material. The sleeves can be flexible for purposes of folding and/or collapsing the fabric layer 12 for reducing the space occupied during packaging of the insulating cover 10.

With continued reference to FIG. 1A, the insulating cover 10 can further include a socket 38 at each corner 24, 26 of the fabric layer 12. In one embodiment, the socket 38 can be formed from a material that is the same as the fabric layer 12. In this manner, the socket 38 can be formed of a generally flexible fabric. In another embodiment, the socket 38 can be formed of a rigid material or a material that is more rigid than the material forming the fabric layer 12. For example, the sockets 38 can be formed from a rigid plastic or a semi-rigid rubber. The sockets 38 receive a proximate end 40 of a respective rod 22 and anchor the rod 22 into a position maintained at the corner 24, 26 for the fabric layer 12 so that the rods 22 do not continue to slide past the perimeter 14 of the fabric layer 12 and undesirably collapse the insulating cover 10. In this instance, the cavity 20 containing the stationary air would be lost.

With continued reference to FIG. 1A, the sockets 38 extend generally upwardly from the corners 24, 26 of the fabric 12. The sockets 38 are coincident with the axis of the tubular sleeve 28. The gap 30 separates the terminal end 32 of the tubular sleeve 28 from the open end of the socket 38. In this manner, a user can feed the rod 22 through the tubular sleeve 28 and then place the proximate end 40 of the rod 28 into the socket 38. The rod 22 is thus stabilized by the tubular sleeve 28 and the socket 38. The rod 22 erects the fabric sleeve 12 into the tent-like structure, and the socket assists the rod 22 in maintaining that position.

One aspect of the present insulating cover 10 is the seal 42 that prevents air leakage. With continued reference to FIG. 2, the insulating cover 10 includes a seal 42 connected to the fabric layer 12. More specifically, the seal 42 is formed around the fabric layer 12 at the perimeter 14 of the fabric layer 12. When the insulating cover 10 is erect, the seal 42 lies across (i.e., against) the floor/wall surface around the access region. One aspect of the disclosure is that the seal 42 lies flush against the floor when the insulating cover 10 is placed in position. As the insulating cover 10 is lowered into contact with the floor, the fabric layer 12 pushes air outward and away from the cavity 20, which tends to also flatten the seal into proper position.

Figure 1B:
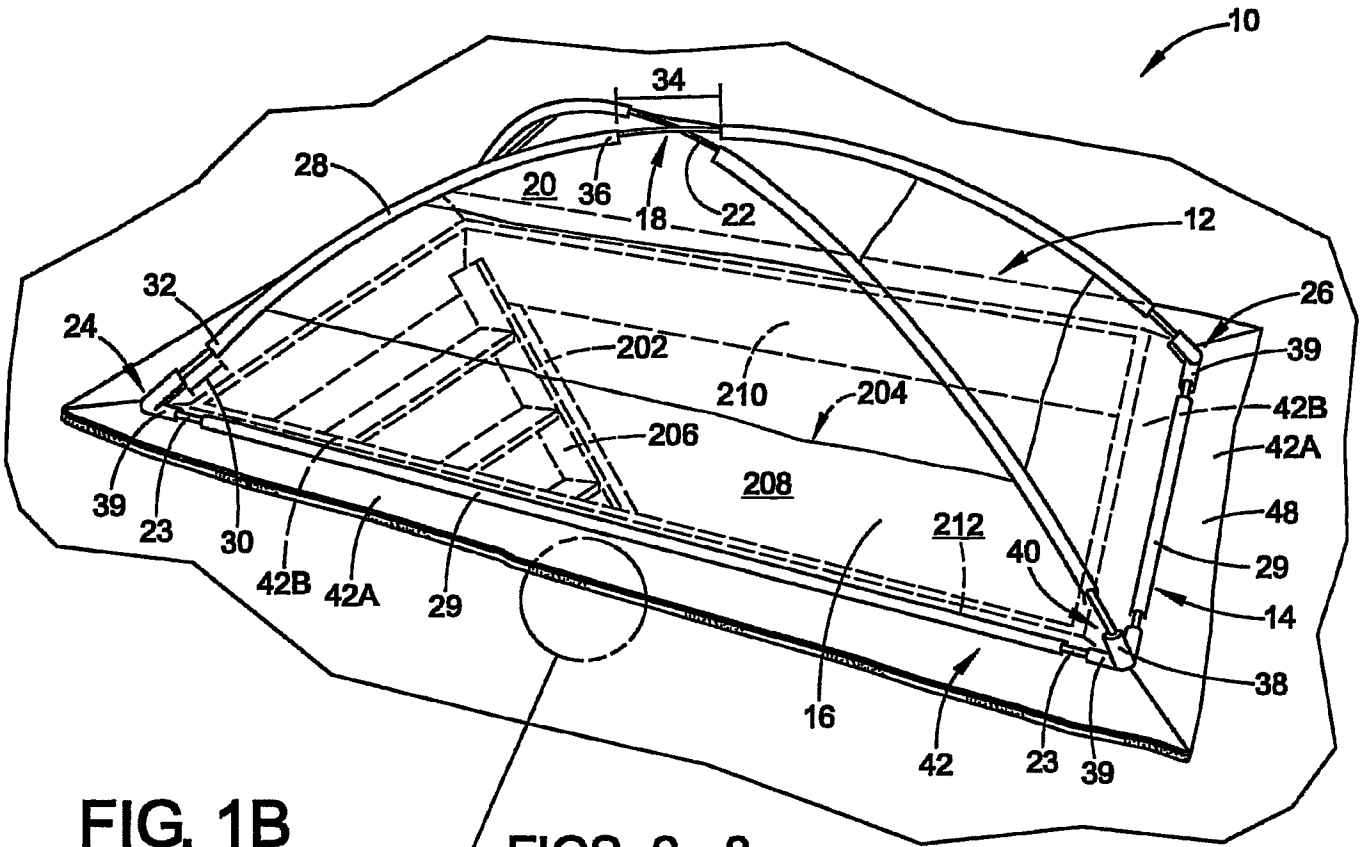
FIG. 1B illustrates a perspective view of another embodiment of the insulating cover observed from an attic space.
Figure 1C:
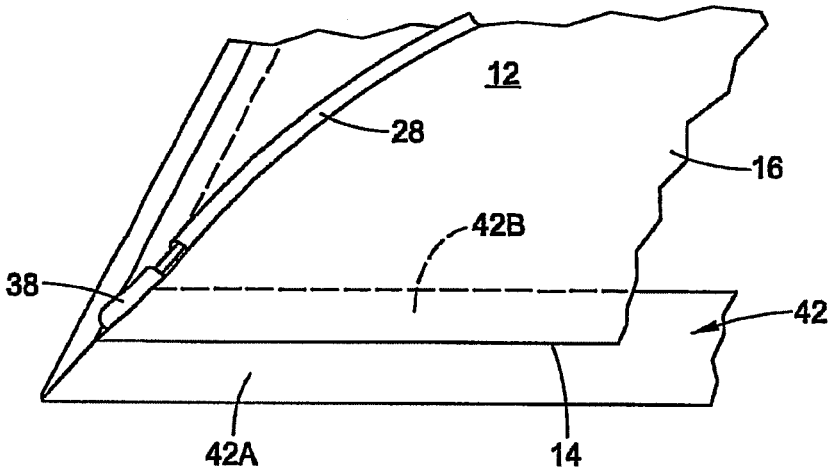
Figure 7:
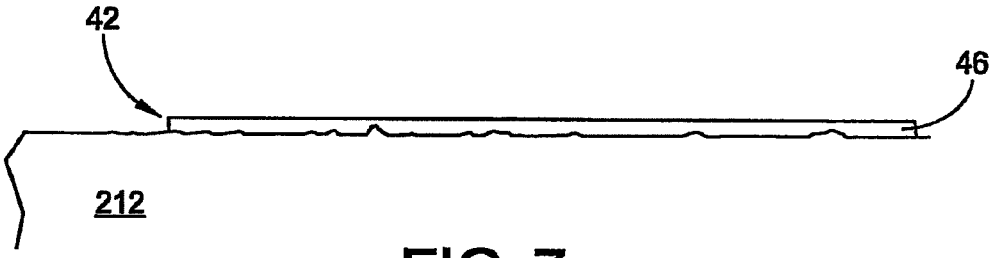
Figure 8:
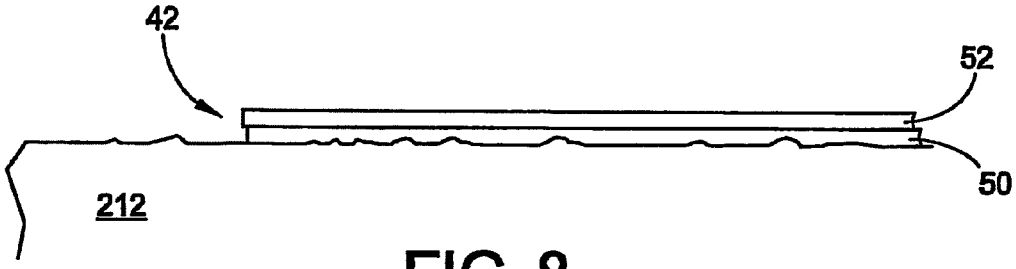
Figure 2:
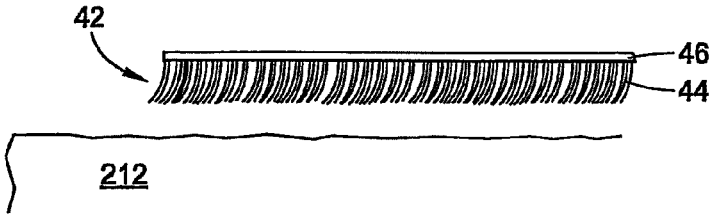
Figure 3:
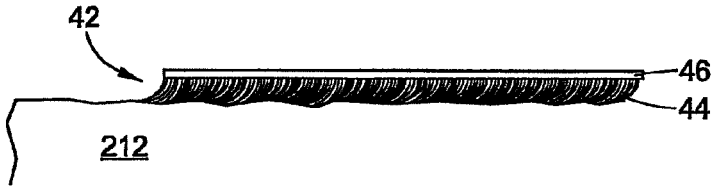
Figure 4:
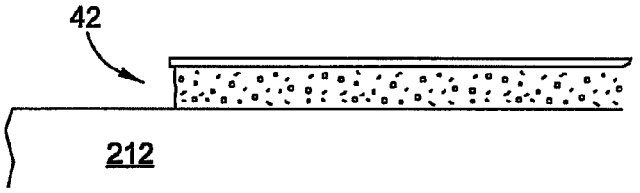
Figure 5:
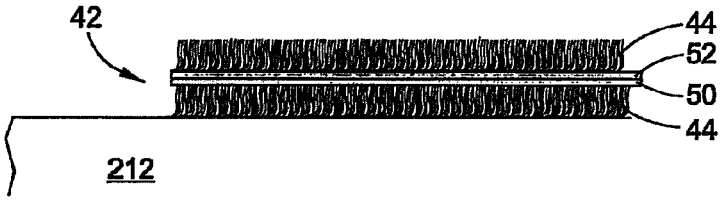
Figure 6:
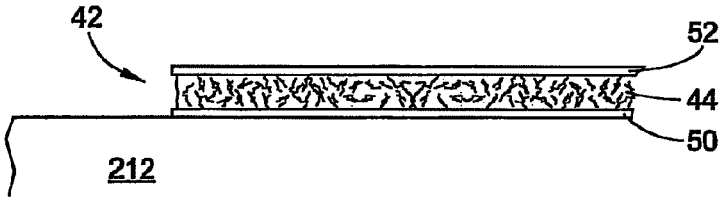

FIG. 1B illustrates another embodiment, referred to herein as a 'bottom framed' embodiment, including at least a one base rod 23 that is adapted for providing additional integrity at the perimeter 14 and/or periphery of the insulating cover 10. The base rods 23 can be rigid or semi-rigid rods that work conjunctively to maintain that the edges defining the fabric layer 12 are urged apart. In this manner, the base rods 23 maintain rigidity to the insulating cover when it is in an operative position. In the contemplated embodiment, at least four base rods are adapted to be received in corresponding tubular base sleeves 29 that are formed through the fabric 12 or the seal 42 at the perimeter 14. However, embodiments are contemplated to omit the base rods 23 when the surface that is supporting the insulating cover is uneven. There is no limitation made herein to the feature used to capture the base rods 23 and maintain the rods in the tubular base sleeves 29. In one example, sockets 39 (analogous to sockets 38 in FIG. 1A) can be formed in the fabric layer 12 or the seal 42 (i.e., coincident to an axis of the respective tubular base sleeve 29) at the corners of the perimeter seal 42 for receiving the base rods 23.

An exploded view of the seal is shown in FIGS. 2-8. The seal 42 is manufactured from a material including multiple fibers 44 and/or strands that extend outwardly and inwardly from a sheet 46 (see FIG. 2) to form a double-seal. In the exemplary embodiment, the seal 42 is about three-inches in diameter, but there is no limitation made herein to its dimensions. In one embodiment, the strands are approximately three inches in length, but shorter lengths are contemplated. No limitation is made herein to the length.

With continued reference to FIG. 1A, the seal 42 is formed of four trapezoidal shaped sections 48 so that the seal 42 is in complete contact with the floor surface 212 surrounding the fabric layer 12 when the fabric layer 12 extends upwardly at the perimeter when the insulating cover 10 is in operative position. With reference to FIG. 3, the individual fabric strands 44 are malleable and are adapted to compress and generally intertwine as the sheet 46 is lowered into general contact with the floor surface 212. In this manner, the strands 44 collectively conform to the contour of the floor surface 212 to seal any gaps that may form between the sheet 46 and a non-uniform surface 212.

More specifically, when a traditional seal having a generally uniform surface is laid across a floor, small gaps form between the seal and the floor surface. These gaps can cause air leakage, however minimal they are. The gaps are formed because the floor is non-uniform at close examination. Leaks will form between a generally flat seal and a generally flat floor because the seal does not generally lie exactly flush to the floor based on imperfections in the floor and seal. Therefore, one aspect of the presently disclosed seal is that it includes the strands 44 for sealing potential openings that are caused by the imperfections formed between the sheet and the floor.

With continued reference to FIG. 3, the strands conform to the floor surface to seal the gaps formed between the sheet 46 and the floor 212. In one embodiment, the seal 42 is manufactured from a synthetic fur material. In another embodiment, the seal 42 is manufactured from a velour material. In one embodiment, the material is Terylene, which is a synthetic polyester fiber. However, any material including multiple fibers and/or strands of similar characteristics is contemplated. In yet another embodiment, the seal 42 may be formed from any material including conforming characteristics, such as, for example, a foam layer (see FIG. 4).

With reference to FIG. 5, one embodiment of the insulating cover 10 includes the seal 42 formed of at least two sheets 50, 52 of material. The two sheets 50, 52 may be formed, for example, from velour or fabric material. A first sheet 50 rests against the floor surface 212 and includes strands 44 extending downwardly toward the floor 212. A second sheet 52 abuts the generally flat, outer-oriented surface of the first sheet 50. The second sheet 52 includes strands 44 on an opposite surface that extend outwardly away from the floor 212.

With reference to FIG. 6, in another contemplated embodiment, the seal 42 can include a first flexible sheet 50, such as a fabric sheet, that conforms to the floor 212. Strands 44 extend upwardly from the first sheet 50 in a direction away from the floor 212. A second sheet 52 includes strands 44 that extend downwardly toward the floor 212. In this manner, the strands 44 of the first and second sheets 50, 52 intertwine with one another as they meet and collectively fill any gaps that may cause leakage.

There is no limitation made herein to a combination of sheets and materials used to manufacture the seal 42 of the insulating cover. For example, FIG. 7 shows a seal 42 that can include a first flexible sheet 46' that conforms to the floor surface. In yet another embodiment, shown in FIG. 8, the seal 42 can include at least two layers of flexible sheets 50', 52' that each conform to the floor surface.

In this manner, the disclosed insulating cover 10 provides an effective seal for maintaining the volume of stationary air in the cavity 20 defined by the insulating fabric layer 12. Another aspect of the disclosure is an insulating cover that is adapted to be provided in a collapsed state when the insulating cover is not operational. One aspect of a sale of insulating covers in the collapsed state is a reduced package site and weight when compared to an assembled product performing a similar function. This results in reduced transportation and/or shipment costs from the manufacturer to the distributor and/or from the distributor to the purchaser. Another aspect of the insulating cover being provided in a collapsed state is that it requires less space consumption on the shelves or in contained storage units. Another aspect of the insulating cover provided in a collapsed state is easier passage of the cover 10 through the attic recess 208 at a time of assembly.

Figure 9:
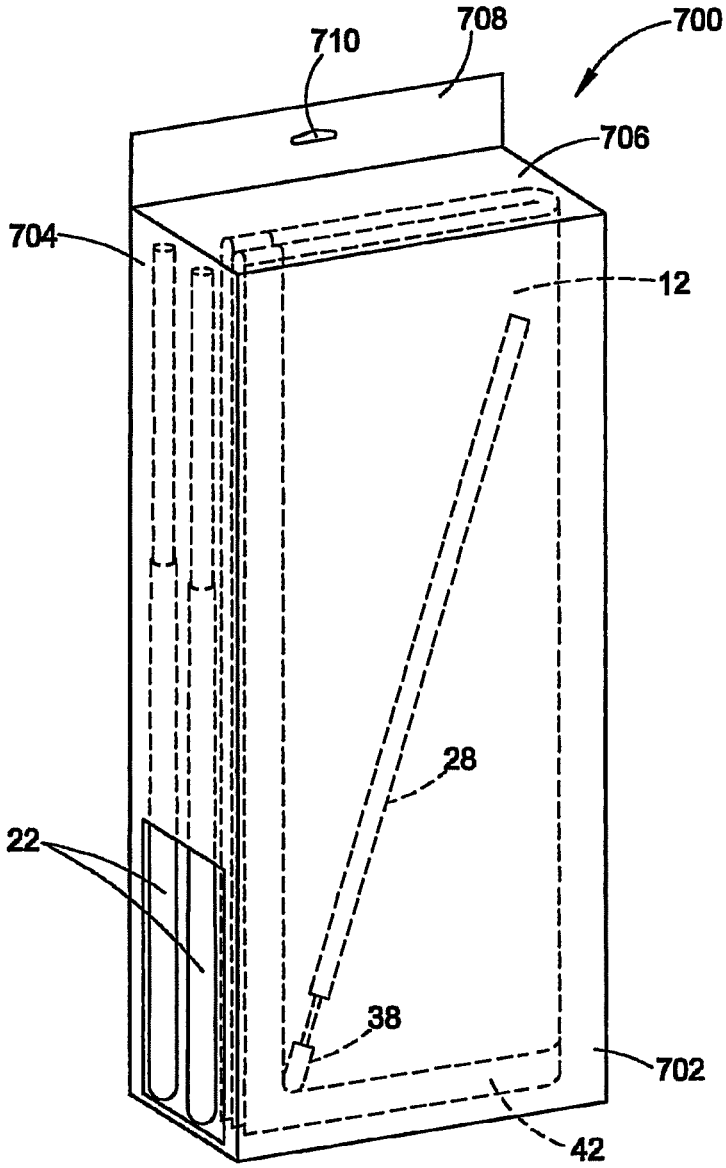
FIG. 9 illustrates a packaged insulating cover according to an embodiment of the disclosure.

Another embodiment of the present disclosure is illustrated in FIG. 9. FIG. 9 shows a packaged insulating cover 700. The packaged insulating cover 700 includes at least a first sidewall 702 opposite a second sidewall (not shown) and a third sidewall 706 connecting the first and second sidewalls 702. The illustrated embodiment includes a fourth sidewall 704 opposite a fifth sidewall (not shown) and connected by the third sidewall 706. In this manner, a cavity (not shown) is formed between and defined by the sidewalls 704, 706. The fabric layer 12 of the insulating cover 10 can be contained in the cavity. In one embodiment, the fabric layer 12 is folded at least one time for reducing a cross-sectional area of the fabric layer 12. In the exemplary embodiment, the fabric layer 12 is folded multiple times to include a cross-sectional area that is smaller than a sidewall 702-704 of the package. The package 700 can also include a tab 708 with an aperture 710 formed through the tab 708. The tab 708 is adapted for hanging and/or suspending the package 700 on a display rack (not shown).

Figure 10A:
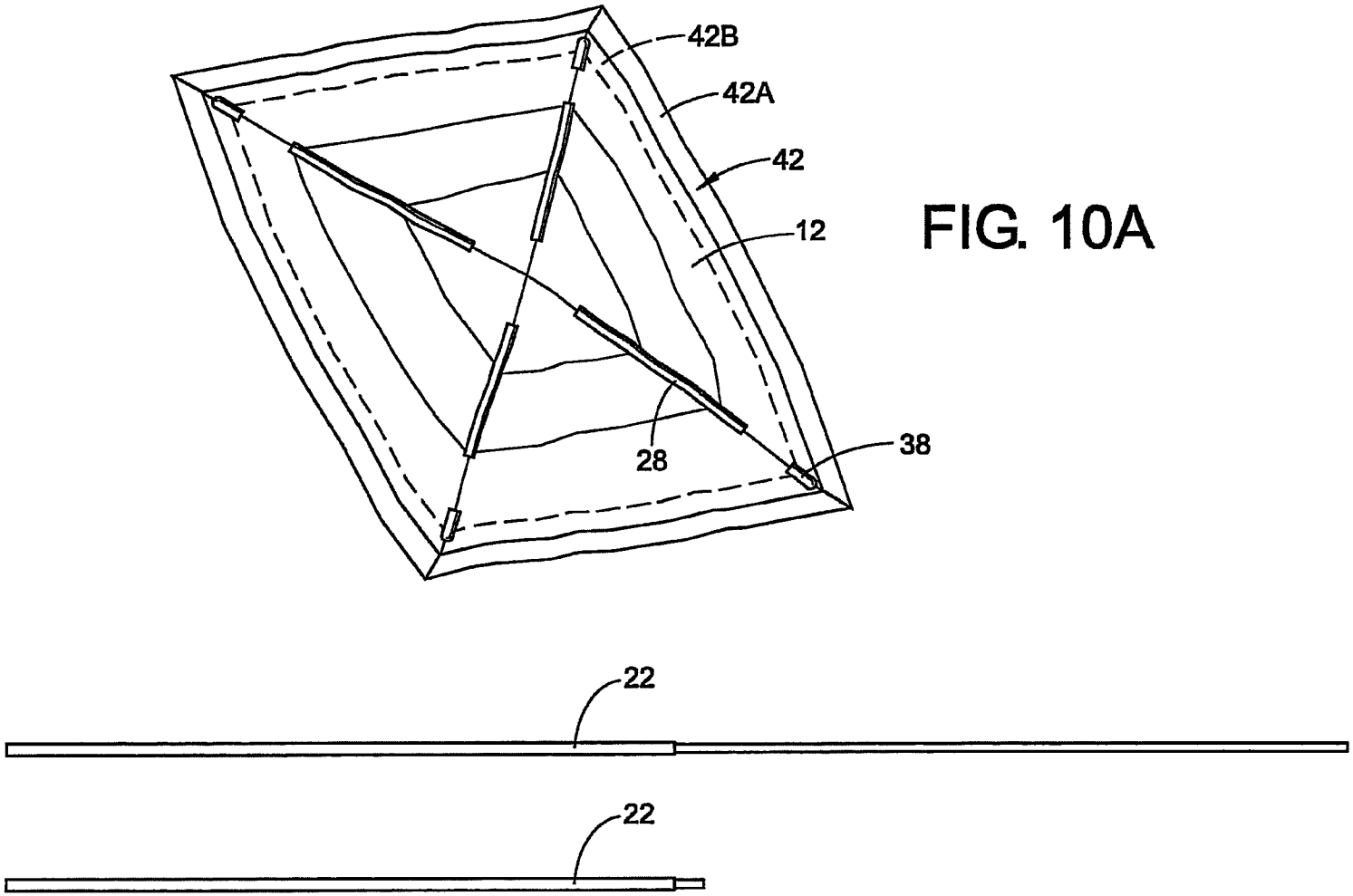
FIGS. 10A and 10B illustrate the insulating covers shown in FIGS. 1A and 1B in a disassembled state; and, FIG. 11 illustrates another embodiment of a packaged insulating cover and display according to the subject matter of the disclosure.
Figure 10B:
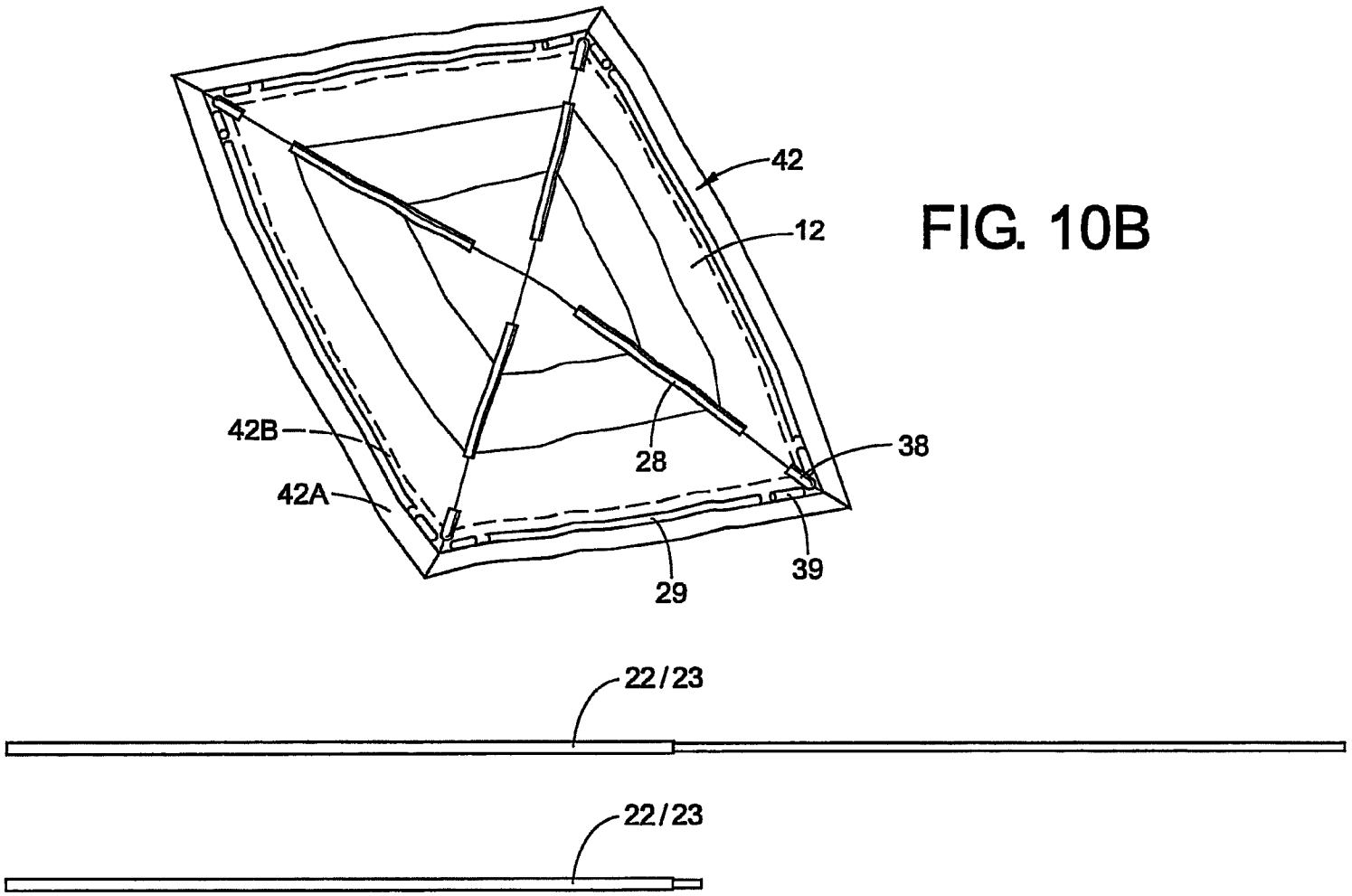

The packaged insulating cover 700 includes the insulating cover 10 in a disassembled state. When the package 700 is opened, the insulating cover 10 can be removed as multiple, separate parts that are ready for assembly. These parts are removed from the package 700 and illustrated in FIGS. 10A and 10B. FIG. 10A illustrates an unfolded fabric layer 12 having the tubular sleeves 28, the sockets 38, and the seal 42 connected to the fabric layer 12. FIG. 10B illustrates the unfolded fabric layer 12 having the tubular base sleeves 29 and the tubular sockets 39 formed along the perimeter of the fabric layer 12. At least two rods 22 are also included in the package 700 as separate items from the fabric layer 12. FIG. 10B illustrates the rods as including base rods 23. In one embodiment, the rods 22, 23 can be formed of multiple telescoping sections such that they can be contained in the package 700 at a reduced length. FIGS. 10A and 10B show a first rod 22, 23 fully extended and a second rod 22, 23 fully collapsed. In another embodiment (not shown), the rods 22 can be formed of multiple sections that can be connected together to form each rod. Each section can include a partial extent of the rod. The rod sections can connect by any conventional manner, such as, for example, by corresponding threading included on respective rod sections or by an interference fit. The rods 22 are adapted to be inserted into the tubular sleeves 28, 29 when the insulating cover 10 is selectively assembled.

Figure 11:
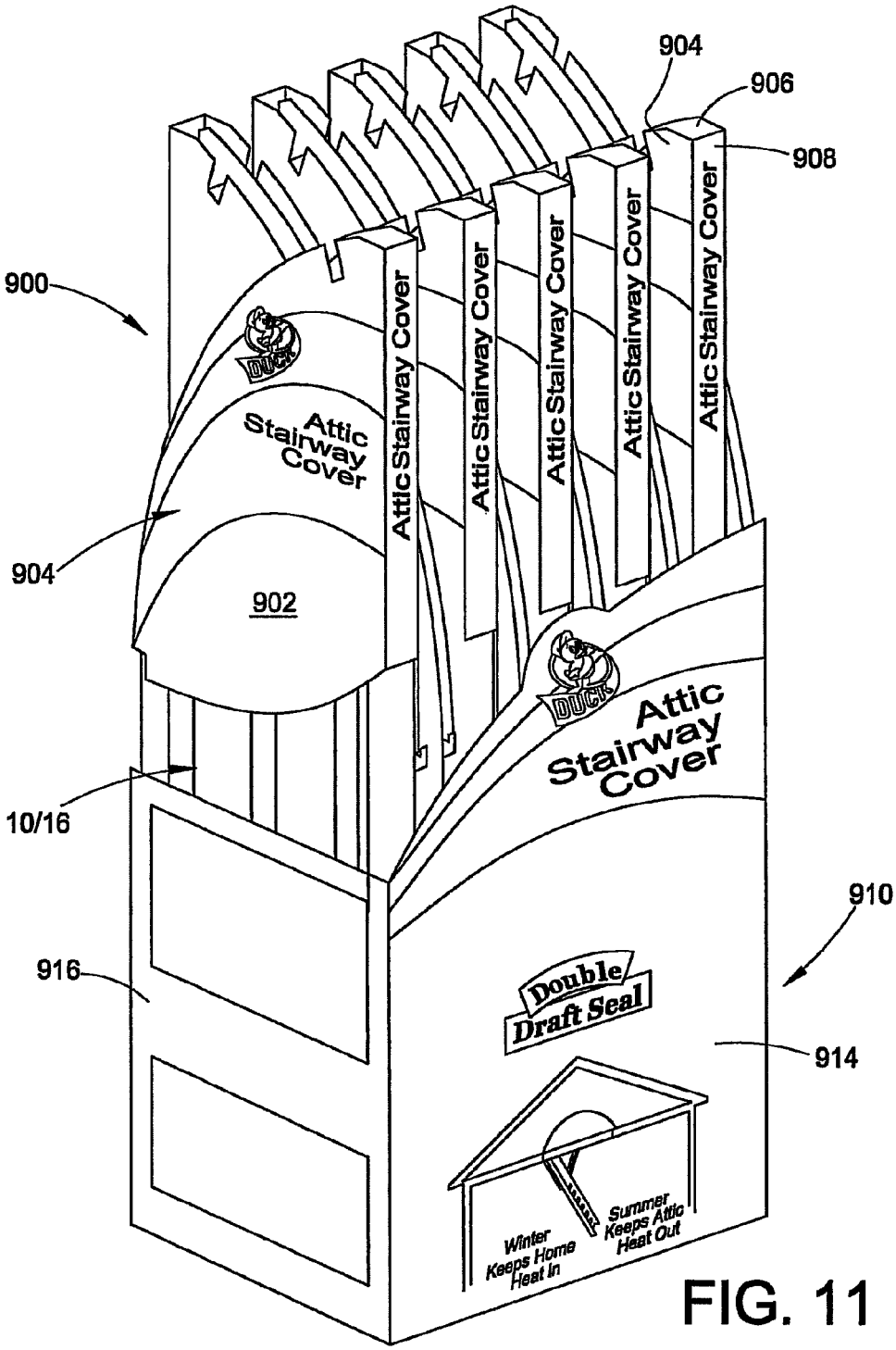

Another embodiment of a packaged insulating cover 900 is illustrated in FIG. 11. The packaged insulating cover 900 contains the insulating cover 10. However, unlike the packaged insulating cover 700 illustrated in FIG. 9, the insulating cover 10 contained in package 900 is partially assembled. The rods 22 are already inserted through the respective tubular sleeves 28 and received in the respective sockets 38.

With continued reference to FIG. 11, the packaged insulating cover 900 contains the fabric layer 12 as folded at least twice along the (inside edges and/or) seams defining the (contoured edges of the) wedge-shaped portions 16. More specifically, the folds occur along the same axes that include sleeves 28 receiving the rods 22. The folds generally provide layers of the four wedge-shaped portions 16 in an overlapping relationship. Therefore, the layers include the rods 22 extending along an outer parabolic edge and respectively connecting at opposite ends to two, generally linear, inside edges. In one embodiment, the rods 22 can each include two sections maintained in respective sleeves and adapted to be connected at the exposed gap that is included at the center 18 of the fabric layer 12 when the fabric layer 12 is unfolded.

With continued reference to FIG. 11, the packaged insulating cover 900 further includes a generally rigid slip cover 902 adapted to receive a portion of the folded insulating cover 10. The slip cover 902 includes a first sidewall 904 situated opposite a second side wall (not shown). A third, generally horizontally-extending sidewall 906 connects the outside parabolic edges of the first and second walls 904 along at least an extent portion of the parabolic edges. A fourth longitudinally extending sidewall 908 connects an inside, generally linear edge of the first and second walls 904. The third sidewall 906 generally extends adjacent to an extent portion of the parabolic contour of the wedge layers. Similarly, the fourth sidewall 908 generally extends adjacent to an extent portion of the linear edges forming the wedge layers. The third and fourth sidewalls 906, 908 include widths that are slightly greater than the combined width formed from the four layers of wedge portions 16.

With continued reference to FIG. 11, the package 900 is illustrated as forming a cavity defined by the first, second, third, and fourth sidewalls 904-908. The cavity is adapted to receive an end portion of the wedge-layers. In contemplated embodiments, a second slip can be received on an opposite end portion of the wedge layers, or a slip can be adapted to extend along the entire extent of the wedge-layers.

FIG. 11 also shows a display 910 for containing multiple packaged insulating covers 900. The display 910 includes a bottom wall (not shown) and multiple sidewalls 912, 914 extending upwardly from each edge defining the bottom wall. The preferred embodiment includes at least four sidewalls. The sidewalls 912, 914 can be the same or different heights. The display 902 is adapted to contain multiple insulating cover packages 900 that are aligned vertically and side-by-side, as opposed to being horizontally stacked. In the illustrated embodiment, the multiple insulating cover packages 900 are also aligned in alternating orientation, whereby the parabolic, contoured edge of the packages 900 alternate between facing the inside surface of sidewall 914 of the display 910 and the outer oriented section of the display 910. In one embodiment, the width of the display 910, as defined by a length of sidewall 916 is approximate the same as or slightly greater than the length of the short edge of each folded wedge portion. Each packaged insulating cover 900 can be removed by lifting it upward and out of the containment space formed by the four sidewalls.

In yet another embodiment, the insulating cover 10 may be provided in a kit. The kit may include the fabric layer 12 in a rolled, folded, and/or flattened state, etc. and at least two rods and/or more rod sections. There is no limitation made herein to the components that may be included in packaging with the insulating cover 10.

One aspect of the present disclosure is a flexible and lightweight insulating cover that is repositionable for convenient access to the attic space. The insulating cover is easy to assemble and can be installed in a few steps. The cover is adapted to block drafts and retain room temperatures, thus providing an efficient means for reducing energy costs.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An insulating cover adapted for sealing an attic access panel, the insulating cover comprising:

a substantially rectangular fabric layer;

at least one rod for raising the fabric layer above the attic access panel;

a cavity defined by the fabric layer, the cavity being adapted to contain a volume of stationary air;

a seal formed around a perimeter of the fabric layer, the seal including multiple fiber strands of material each being of a length adapted to compress, intertwine and conform to a shape of a floor surface to collectively seal gaps formed where the cover meets the floor surface.

2. The insulating cover of claim 1, wherein the seal includes a fur material.

3. The insulating cover of claim 1, wherein the seal includes a velour fabric material.

4. The insulating cover of claim 1, wherein the seal includes a first sheet of velour material connected to a second sheet of velour material, wherein the multiple fiber strands forming the velour material on the first and second sheets are situated opposite each other.

5. The insulating cover of claim 1, further including at least one tubular sleeve formed on an outside of the fabric layer and extending between a corner of the fabric layer and a center of the fabric layer, the tubular sleeve being adapted for receiving the at least one rod.

6. The insulating cover of claim 5, wherein the tubular sleeve terminates before the corner of the fabric layer.

7. The insulating cover of claim 5, wherein the tubular sleeve terminates before the center of the fabric layer.

8. The insulating cover of claim 5, further including a socket formed on an outside of the fabric layer and situated at a corner of the fabric layer, the socket being coincident with an axis formed along the tubular sleeve, the socket being adapted to receive a terminal end of the at least one rod.

9. The insulating cover of claim 1, further including at least one base tubular sleeve formed along the perimeter of the fabric layer, and at least one base rod extending through the base tubular sleeve.

10. The insulating cover of claim 1, wherein the seal is adapted to lie over the floor surface when the insulating cover is in operative position and the fabric layer is adapted to extend outwardly above the floor surface where the fabric layer meets the seal.

11. An insulating cover adapted for sealing an attic access panel, the insulator comprising:

a generally flexible fabric layer formed of an insulating material;

at least one tubular sleeve extending across a portion of the fabric layer;

at least one semi-rigid rod being adapted to extend through the at least one tubular sleeve, the at least one rod being further adapted to raise and position the fabric layer around the access panel such that a stationary air cavity is formed between the fabric layer and the access panel;

a seal connected to an edge of the fabric layer, the seal including a first seal portion extending inwardly from the edge of the fabric layer and a second seal portion extending outwardly from the edge of the fabric layer;

wherein the seal is adapted to lay against a floor surface adjacent the access panel when the fabric layer is raised by the at least one rod and prevent air leakage between the stationary air cavity and an attic space beyond the fabric layer.

12. The insulating cover of claim 11, wherein the seal includes multiple fiber strands being adapted to conform to a non-uniform contact surface representative of the floor surface, the fiber strands being adapted for sealing a gap formed between the seal and the floor surface.

13. The insulating cover of claim 11, wherein the seal is manufactured from a group consisting of: a synthetic fur; at least one sheet of velour material; and, a combination of the above.

14. The insulating cover of claim 11, further including at least three tubular sleeves each extending between a corner of the fabric layer and a center of the fabric layer.

15. The insulating cover of claim 11, further including a gap formed between the at least two of the tubular sleeves at the center of the fabric layer.

16. The insulator of claim 11, further including a socket formed at each corner of the fabric layer.

17. The insulator of claim 14, further including a gap formed between the at least one tubular sleeve and the socket.

* * * * *